United States Patent [19]

Porter

[11] 4,399,640

[45] Aug. 23, 1983

[54] THERMAL INSULATION DEVICE

[76] Inventor: Michael W. Porter, 5633 Derby Ct., Apt. #22, Alexandria, Va. 22311

[21] Appl. No.: 271,560

[22] Filed: Jun. 8, 1981

[51] Int. Cl.[3] ..... E06B 3/26; E06B 3/28; A47H 3/00

[52] U.S. Cl. ..... 52/202; 52/222; 160/368 R; 160/369

[58] Field of Search ..... 52/202, 222, 718; 160/354, 368 R, 369, 380

[56] References Cited

U.S. PATENT DOCUMENTS

| | | | |
|---|---|---|---|
| 2,080,394 | 5/1937 | Ballantyne | 52/202 |
| 3,058,518 | 10/1962 | Housman | 160/380 |
| 3,681,887 | 8/1972 | Loew | 52/718 |
| 3,913,655 | 10/1975 | Ogino | 160/354 |
| 4,068,428 | 1/1978 | Peterson | 52/202 |
| 4,103,728 | 8/1978 | Burdette | 160/368 R |
| 4,164,105 | 8/1979 | Herbst et al. | 52/202 |
| 4,184,297 | 1/1980 | Casamayor | 52/202 |
| 4,189,880 | 2/1980 | Ballin | 160/380 X |
| 4,193,235 | 3/1980 | Cucchiara | 160/380 X |
| 4,265,383 | 5/1981 | Ferguson | 52/718 X |
| 4,272,942 | 6/1981 | Jackson | 52/202 |

FOREIGN PATENT DOCUMENTS

| | | | |
|---|---|---|---|
| 2008942 | 12/1970 | Fed. Rep. of Germany | 52/222 |
| 317485 | 11/1969 | Sweden | 52/222 |

*Primary Examiner*—John E. Murtagh
*Assistant Examiner*—Richard E. Chilcot, Jr.
*Attorney, Agent, or Firm*—Shlesinger, Arkwright, Garvey & Fado

[57] ABSTRACT

A snap-on insulation barrier for window frames including an elongated base member having means for securing the base member to the frame, the base member being generally of strip configuration and having a pair of opposed rails having portions extending upwardly and outwardly from the base member, the base member having side members and the side members extending beyond the outwardly extending portions of the opposed rails a substantial distance and forming with the outwardly extending portions of the rails a pair of opposed U-slots. Also provided is a second strip having a C-shaped cross section with inturned ends for engaging in the U-slots and having inside and outside surfaces. On the outside surface of the second strip is an upstanding bead running the length thereof. Also provided is a third strip having inside and outside surfaces and having an expandable slot formed by flexible opposed rails running the length of the inside surface conforming to and co-operating with the bead for snap fit over the bead. The outside surface of the third strip is substantially flat and includes a pressure sensitive material for securing a plastic sheet thereto. The strips are conformable to the frame.

13 Claims, 3 Drawing Figures

THERMAL INSULATION DEVICE

FIELD OF THE INVENTION

This invention relates to insulation devices for windows and more particularly to a snap-on insulation barrier for window frames.

BACKGROUND OF THE INVENTION

With an increasing need for energy conservation the result of rapidly increasing costs for fuel heating as well as diminishing natural fuels, there has arisen a demand for products that help reduce fuel consumption. One solution has been the installation of glass storm windows to existing window frames thereby providing a secondary insulation barrier. For many people, glass storm windows do not provide an adequate solution to the problems due to their high cost. In view of this, less expensive alternatives have been gaining wide spread popularity. One of these devices is described in U.S. Pat. No. 3,058,518 to Housman, wherein an endless snap clip is disclosed for detachably securing pliable sheets of material across a window structure. The sheet material is secured between a male base member and a co-operating female clamping member. One problem inherently associated with such a structure, is the stress placed upon the flexible sheet of material that is secured between the co-operating clamping members. With repeated disengagement of the clamping device, there is a tendency for the flexible sheet material to become damaged due to frictional contact between the co-operating clamping members. Other attempts for providing temporary thermal insulation devices have included U.S. Pat. Nos. 4,068,428 to Peterson, 4,189,880 to Ballin, 4,164,105 to Herbst, 4,103,728 to Burdette, 2,080,394 to Ballantyne, 4,184,297 to Casamayor and 4,193,235 to Cucchiara. While these devices have been somewhat successful in providing temporary thermal insulation for windows, they are nonetheless, overly complicated in construction or unsightly in appearance.

OBJECTS AND SUMMARY OF THE INVENTION

It is therefore one object of the present invention to provide a snap-on insulation barrier for window frames.

It is another object of the present invention to provide an insulation barrier for windows which is simplified in construction and is easily assembled and disassembled.

It is a further object of the present invention to provide a thermal insulation barrier for windows which is conformable to a variety of existing window structures.

It is still another object of the present invention to provide an insulation barrier for windows which is inexpensive.

It is still a further object of the present invention to provide an insulation barrier for window frames which allows removal of a sheet of flexible material in order to provide access to the underlying window without causing damage to the flexible sheet material.

In summary this invention relates to a snap-on insulation barrier for window frames including an elongate base member having U-shaped channeled sides, a second resilient elongate strip having a C-shaped cross section and having inturned ends for snap fit engagement within the U-shaped channels of the base member.

The foregoing and other objects and advantages of this invention will appear from the following detailed description, taken in connection with the accompanying drawings.

DETAILED DESCRIPTION OF THE INVENTION

Figure 1:
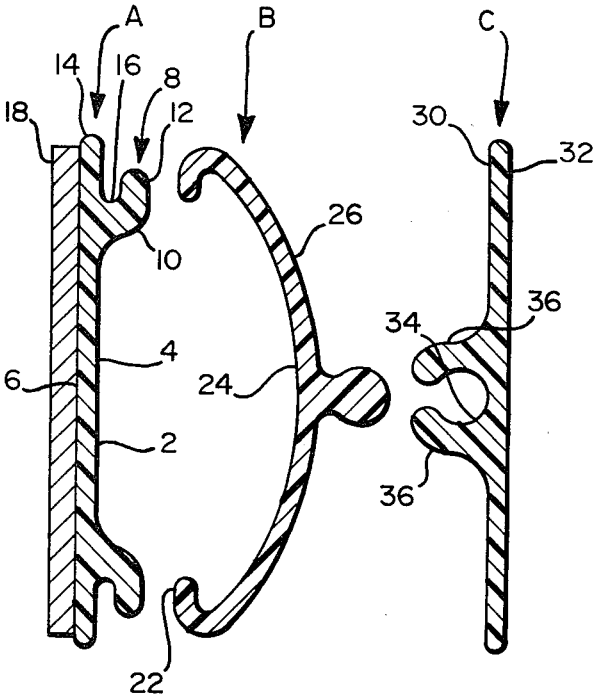
FIG. 1 is an exploded side elevational view of the various elements of the thermal insulation device.
Figure 2:
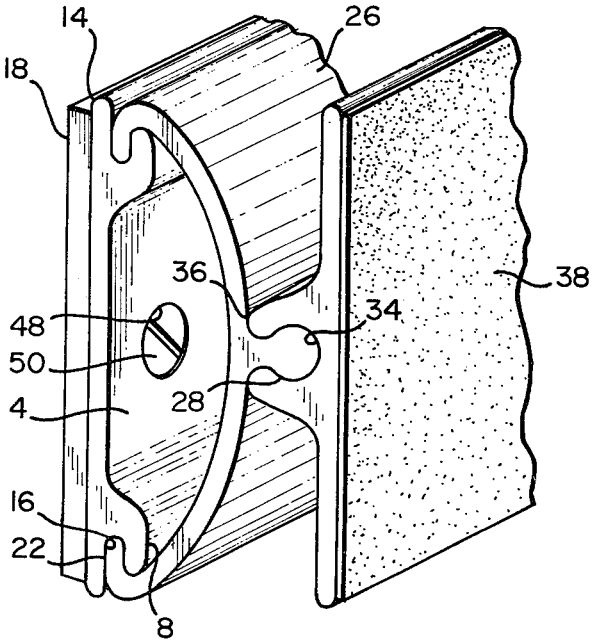
FIG. 2 is a fragmentary perspective view showing the elements co-operatively engaging one another.

FIGS. 1 and 2 show a support member A having a base member 2 with a front surface 4 and a back surface 6. Base member 2 is generally of strip configurations and includes a pair of opposed rails 8 having portions 10 extending upwardly and portions 12 extending outwardly therefrom. Base member 2 also includes side members 14 which are planer extensions of base member 2. Side members 14 extend outwardly beyond portions 12 and form with rails 8 a pair of opposed U-shaped channels 16. Directly adjacent back surface 6 is attached pressure sensitive material 18 for securing support member A to a wall or as shown in FIG. 3, to window frame 20.

A second elongated strip B is shown in FIGS. 1 and 2 having a C-shaped cross section with inturned ends 22. Strip B includes an inner surface 24 and an outer surface 26. Running the length of outer surface 26 is an upstanding bead 28.

A third elongated strip C is shown as having inside surface 30 and an outside surface 32. An expandable slot 34 is formed by flexible opposed rails 36 running the length of inside surface 30, conforming to and co-operating with bead 28 for snap fit over bead 28. Outside surface 32 is substantially flat and includes a pressure sensitive material 38 for securing a sheet of plastic material 40 thereto.

Figure 3:
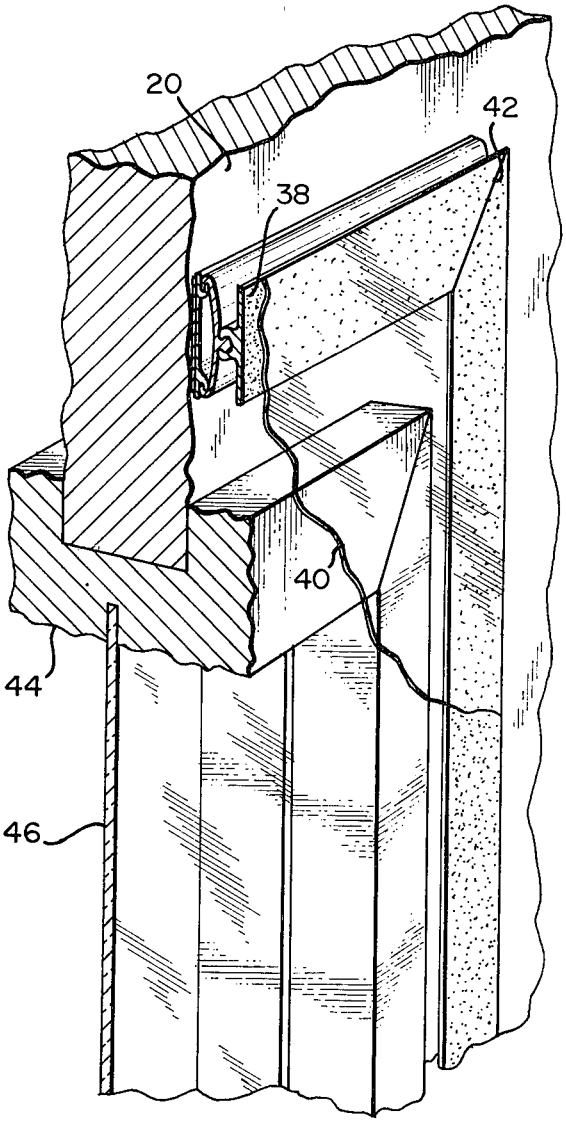
FIG. 3 is a fragmentary perspective view portions of which are cut away and in cross section to show the thermal insulation device as attached to a window structure.

In FIG. 3, the assembled thermal insulation device is shown as attached to window frame 20 with edges cut at an angle to provide a corner construction as indicated at 42. Sheet material 40 attached to pressure sensitive material 38 is stretched across window 44 in which is anchored a glass plane 46.

OPERATION

In assembling the thermal insulation apparatus, support member A is first cut to size, after which, it is mounted upon a window frame 20 or upon window structure 44. Fastening of support member A to window frame 20 is achieved by the use of pressure sensitive material 18. To provide a more permanent attachment, base member 2 may be provided with a number of holes 48 into which screws 50 are inserted, to secure base member 2 to the mounting surface.

After mounting support member A, resilient strip B is placed thereon, so that inturned ends 22 rest upon outwardly extending portions 12. By applying pressure to outer surface 26 of resilient strip B, inturned ends 22 expand outwardly, thereby allowing inturned ends 22 to clear the outwardly extending portions 12 of rails 8 and to subsequently snap into locking engagement with U-shaped channels 16.

Third strip C is next aligned above strip B so that flexible rails 36 contact upstanding bead 28. Upon the application of pressure to outside surface 32, flexible rails 36 are caused to expand, thereby allowing the mating surfaces of expandable slot 34 and bead 28 to snap into locking engagement as is best shown in FIG. 2.

Other lengths of strip members A, B, and C are cut to size and mounted as described above in order to completely border window 44. Plastic sheet material 40 is then cut to size, and secured to pressure sensitive material 38 of third strips C. Any excess sheet material 40 may be trimmed off. Thus secured in place, a secondary thermal barrier is formed between plastic sheet material 40 and window 44. It is obvious that the thermal insulation device as described may be mounted around other window configurations than shown, on either the inside or the outside of the dwelling.

When it is necessary to gain access to the area behind plastic sheet material 40 as for window cleaning purposes or for the manipulation of venetian blinds or window shades (not shown), strip C may be grabbed on an edge surface and pulled to separate the connection between rails 36 and bead 28. Any or all of the strips C may be removed as is required. In the removal process, sheet material 40 remains adhered to pressure sensitive material 38 of the strips C. In this manner, it is not necessary to remove plastic sheet material 40 from strips C once plastic sheet material 40 has been secured thereto.

Each of the strips A, B and C are preferably made of light weight thermoplastic material. Sheet material 40 may be clear or tinted depending upon the user's needs. It is also contemplated that outer sheet material 40 may be replaced by a screen, for use in warm weather.

It should also be noted that the strip materials A, B or C in forming the insulation barrier may be laid out in many shapes other than rectangular as shown in the figures, in order to accommodate openings or the like having shapes other than rectangular.

While this invention has been described as having a preferred design, it will be understood that it is capable of further modification. This application, is therefore, intended to cover any variations, uses, or adaptations of the invention following the general principles thereof and including each departures from the present disclosure as come within known or customary practice in the art to which this invention pertains, and as may be applied to the essential features hereinbefore set forth and fall within the scope of this invention or the limits of the claims.

What is claimed is:

1. A snap-on insulation barrier for window frames and the like including:

(a) an elongated base member having means for securing said base member to said frame, (b) said base member being generally of strip configuration and having a pair of opposed rails having portions extending upwardly and outwardly from said base member, (c) said base member having side members, (d) said side members extending beyond said outwardly extending portions a substantial distance and forming with said outwardly extending portions of said rails a pair of opposed U-slots, (e) a second strip having a substantially C-shaped cross section and having inturned ends for engaging in said U-slots and having inside and outside surfaces, (f) said second strip having on said outside surface a first engaging means running the length thereof, (g) a third strip having inside and outside surfaces and having second engaging means running the length of said third strip inside surface for cooperating with said first engaging means and for detachably securing thereto, said first and said second engaging means including an upstanding bead for engaging an expandable slot formed by opposed flexible rails, (h) said third strip having its outside surface substantially flat and including a pressure sensitive material, (i) an outer sheet secured to said third strip outside surface by said pressure sensitive material, and (j) said strips conformable to said frame.

2. A snap-on insulation barrier for window frames and the like as in claim 1 and wherein:

(a) said base member including front and back surfaces, (b) said means for securing said base member to said frame including pressure sensitive material attached to said back surface of said base member.

3. A snap-on insulation barrier for window frames and the like as in claim 1 and wherein:

(a) said means for securing said base member to said frame including a plurality of holes in said base member and (b) screws positioned within said holes and anchoring said base member to said frame.

4. A snap-on insulation barrier for window frames and the like as in claim 1 and wherein:

(a) said second strip is resilient and (b) said inturned ends being outwardly expandable to provide clearance over said outwardly extending portions of said opposed rails and (c) said inturned ends contractable for locking engagement within said U-slots.

5. A snap-on insulation barrier for window frames and the like as in claim 1 and wherein:

(a) said strips are preferably made from a thermoplastic material.

6. A snap-on insulation barrier for window frames and the like as in claim 1, wherein:

a. said upstanding bead being associated with said second strip; and, b. said expandable slot being associated with said third strip.

7. A snap-on insulation barrier for window frames and the like as in claim 1 wherein:

a. said outer sheet includes a plastic sheet.

8. A readily assembled thermal insulation device for window structures including:

a. an elongated, wall mountable member having a flat base member with front and back surfaces and having sides with longitudinal channels therein, b. said channels surrounded by a front and a rear ridge of unequal height, (c) said front ridge projecting from said front surface of said base and extended outwardly therefrom in a direction generally parallel to said base, (d) said rear ridge being a lateral extension of said flat base, (e) said front ridge being of lesser height than said rear ridge, (f) means for securing said wall mountable member to a wall surface, (g) a resilient elongated support member with a generally C-shaped cross section and having flanged edges for engaging said longitudinal channels in said wall mountable member, (h) said resilient support member having an inner and an outer surface, (i) an elongated first engaging member co-extensive with said resilient support member and projecting from said outer surface of said support member, (j) an elongated engaging member co-extensive with said support member and having a front and a back surface, (k) an elongated second engaging member extending outwardly from said back surface of said engaging member for interengagement with said first engaging member of said support member, (l) said front surface of said engaging member being generally flat and including an adhesive material applied thereto, (m) a sheet of insulating plastic material secured to said front surface by said adhesive material, and (n) said first and said second engaging members including a bulbous rib for cooperating with a resilient C-shaped projection.

9. A readily assembled thermal insulation device for window structures as in claim 8 and wherein:

(a) said means for securing said wall mountable member to a wall including a pressure sensitive adhesive on said back surface of said base member.

10. A readily assembled thermal insulation device for window structures as in claim 8 and wherein:

(a) said means for securing said wall mountable member to said wall including a plurality of holes passing through said base member and (b) anchoring screws within said holes and engaging said wall.

11. A readily assembled thermal insulation device for window structures as in claim 8 and wherein:

(a) said wall mountable member, said support member and said engaging member are made from a thermoplastic material.

12. A readily assembled thermal insulation device for window structures as in claim 6, wherein:

a. said bulbous rib being associated with said support member; and, b. said C-shaped projection being associated with said engaging member.

13. A readily assembled thermal insulation device for window structures as in claim 6, wherein:

a. said bulbous rib being associated with said engaging members; and, b. said C-shaped projection being associated with said support member.

* * * * *